US006588353B2

(12) United States Patent
Doyle et al.

(10) Patent No.: US 6,588,353 B2
(45) Date of Patent: Jul. 8, 2003

(54) PIVOTING BATTENS

(75) Inventors: Robert E. Doyle, Marblehead, MA (US); Tyler N. Doyle, Marblehead, MA (US)

(73) Assignee: Doyle Sailmakers, Inc., Marblehead, MA (US)

( * ) Notice: Subject to any disclaimer, the term of this patent is extended or adjusted under 35 U.S.C. 154(b) by 0 days.

(21) Appl. No.: 09/924,771

(22) Filed: Aug. 8, 2001

(65) Prior Publication Data

US 2002/0026889 A1 Mar. 7, 2002

Related U.S. Application Data

(60) Provisional application No. 60/223,751, filed on Aug. 8, 2000.

(51) Int. Cl.[7] ..... B63A 9/04

(52) U.S. Cl. ..... 114/102.25; 114/89; 114/106

(58) Field of Search ..... 114/102.24, 102.25, 114/102.26, 102.27, 89, 98, 104, 105, 106, 107

(56) References Cited

U.S. PATENT DOCUMENTS

| | | | | |
|---|---|---|---|---|
| 4,838,192 A | | 6/1989 | Stevenson, IV et al. | 114/105 |
| 4,881,480 A | * | 11/1989 | Stevenson, IV | 114/102.25 |
| 5,372,080 A | * | 12/1994 | Sewell | 114/102.12 |
| 5,493,988 A | * | 2/1996 | Kollberg | 114/106 |
| 6,178,906 B1 | * | 1/2001 | Hoyt | 114/102.28 |

FOREIGN PATENT DOCUMENTS

| | | | | |
|---|---|---|---|---|
| AU | 408424 | * | 10/1967 | 114/102.24 |
| DE | 8810394.3 | | 12/1988 | |
| DE | 199 01 909 A1 | * | 7/2000 | |

OTHER PUBLICATIONS

SwingBatten to Bermuda! Palawan's Powered–Up, Rollaway Win, Silver Threads, Newsletter of the Doyle Group, 2002/2003 Newsletter, p. 6.*

Sail Magazine's Freeman K. Pittman Award for Innovation, Description of Product, Doyle Sailmakers, p. 2.*

* cited by examiner

*Primary Examiner*—Sherman Basinger
(74) *Attorney, Agent, or Firm*—Ropes & Gray,LLP

(57) ABSTRACT

The invention is a rigid supporting member that changes position within a pocket of sheet material to accommodate a deployed position and a stowed position, as may be used, for example, with battens in roller furling sails. The member is placed within the pocket formed within sheets of a pliable material, or attached to the pliable material, and the member is movably secured within the pocket, such as with a pivoting fixture. The member may be rotated into a first position that supports a shape of the pliable material when the pliable material is deployed, and a second position that accommodates stowage of the pliable material through folding, rolling, or the like. A variety of control systems may be used to control rotation or other movement of the member, and to control deployment and stowage of the pliable material.

15 Claims, 6 Drawing Sheets

PIVOTING BATTENS

CROSS-REFERENCE TO RELATED APPLICATIONS

This application claims the benefit of, and incorporates by reference, the entire disclosure of U.S. Provisional Patent Application No. 60/223,751 filed on Aug. 8, 2000.

FIELD OF THE INVENTION

The invention relates generally to moveable structural members for supporting pliable sheets of material, and more particularly, to moveable battens for use in roller-furling sails.

BACKGROUND OF THE INVENTION

The use of battens, rigid or semi-rigid members, is known in sail making as a technique for supporting sail shape. Battens may be used, for example, to support the pliable fabric of a mainsail in a roach that extends well beyond the straight line formed between the head and the clew of a sail. Although battens can significantly improve sail shape, they create an impediment to certain sail stowing techniques, such as roller furling.

When roller furling is employed, a sail is furled and unfurled by wrapping the sail about a rotating member, such as a foil, that may be rotatably mounted about a forestay for a jib or genoa, or contained within a mast for a mainsail. Rotation of the rotating member may be controlled using control lines of rope or cable wrapped about a drum, in conjunction with motors, winches, and/or other mechanisms. When the foil is rotated one way, the sail may be deployed (unfurled), and when the foil is rotated the other way, the sail may be stowed (furled).

While the pliable fabric of a sail may be readily wound about a foil, the rigid material of a batten is not so accommodating. Solutions that address this difficulty have been proposed. For example, pneumatically inflatable battens have been proposed, where a bladder shaped like a batten and attached to a sail is inflated to high-pressure. As a significant disadvantage, these inflatable battens do not achieve the same rigidity as battens formed of wood, fiberglass, plastic, carbon fibers, or other rigid materials. Further, the bulk and complexity of a pneumatic system is ill suited to sails, which undergo substantial, and frequently changing stresses and strains. Another proposed system for a self-furling sail with battens may be found in U.S. Pat. No. 4,838,192, to Stevenson, IV, et al. However, as a significant disadvantage, the Stevenson system does not operate with popular roller furling systems.

There remains a need for a batten suitable for use with a roller furling system.

SUMMARY OF THE INVENTION

The invention is a rigid supporting member that changes position within a pocket of sheet material to accommodate a deployed position and a stowed position, as may be used, for example, with battens in roller furling sails. The member is placed within the pocket formed within sheets of a pliable material, or attached to the pliable material, and the member is movably secured within the pocket, such as with a pivoting fixture. The member may be rotated into a first position that supports a shape of the pliable material when the pliable material is deployed, and a second position that accommodates stowage of the pliable material through folding, rolling, or the like. A variety of control systems may be used to control rotation or other movement of the member, and to control deployment and stowage of the pliable material.

An apparatus as described herein may include a sail, a batten, a pocket, and a control system. The batten may be secured to the sail by a pivot. The pocket may surround the batten and be affixed to the sail. The control system may control a rotation of the batten about the pivot.

The apparatus may further include a plurality of battens, each batten having a controllable rotational orientation. The control system may control a rotation of the batten between a furled position and an unfurled position. The control system may include one or more control lines, each control line affixed to the batten and operable to rotate the batten toward at least one of a furled position and an unfurled position. The control system may include at least one spring, the spring affixed to the batten and applying a torque to the batten toward at least one of a furled position and an unfurled position. The control system may include an actuator that controls a rotational orientation of the batten. The actuator may include at least one of a step motor, a servo, a pneumatic device, or a hydraulic device. The actuator may be controlled through a wireless interface.

The pocket may include a lining of at least one of a chafe-resistant or a friction-reducing material. The apparatus may include a roller furling system. The apparatus may include a switch, the switch being activated by a user to rotate the batten between a furled position and an unfurled position. The pivot may be located at an end of the batten, the end of the batten being on at least one of a luff-side of the sail or a leech-side of the sail. The pivot may be located at a center of the batten.

A system for furling sails as described herein may include a rotating means for rotatably securing a batten to a sail; a control means for controlling a rotational orientation of the batten between a furled position and an unfurled position. The system may further include a furling means for furling the sail.

An apparatus as described herein may include a sail; a batten; a pocket affixed to a sail, the batten movably secured within the pocket and the pocket shaped to accommodate a range of motion by the batten that includes a first position for furling the sail and a second position for setting the sail; and a control system that controls movement of the batten between the first position and the second position. The apparatus may include a plurality of battens, each batten having a controllable position. The first position may be a furled position and the second position may be an unfurled position. The control system may further include one or more control lines, each control line affixed to the batten and operable to move the batten toward at least one of a furled position and an unfurled position. The pocket may include a lining of at least one of a chafe-resistant or a friction-reducing material. The apparatus may include a roller furling system.

An apparatus as described herein may include a batten; a pivot attached to the batten; a pocket surrounding the batten; and a fastener securing a control line to the batten and positioned so that a force applied to the control line will rotate the batten about the pivot.

In another embodiment, an apparatus as described herein may include a pliable sheet of material; a rigid member secured to the pliable sheet of material by a pivot; a pocket surrounding the rigid member and affixed to the pliable sheet of material; and a control system that controls a rotation of the rigid member about the pivot.

BRIEF DESCRIPTION OF DRAWINGS

The foregoing and other objects and advantages of the invention will be appreciated more fully from the following further description thereof, with reference to the accompanying drawings, wherein.

DETAILED DESCRIPTION OF CERTAIN EMBODIMENTS OF THE INVENTION

To provide an overall understanding of the invention, certain illustrative embodiments will now be described, including a pivoting batten for use with a roller furling sail system. However, it will be understood that the methods and systems described herein can be suitably adapted to any environment where a rigid member is used to maintain a pliable sheet of material in some predetermined shape. The principles of the invention may be particularly applicable to those environments where the pliable sheet of material may be rolled upon one axis for storage, such as tarps, Bimini tops, dodgers, tents, awnings, and the like. These and other applications of the systems described herein are intended to fall within the scope of the invention.

As used herein, the term 'first position' is used synonymously with terms such as furled position, stowed position, or position for furling, to indicate a position for a batten in which a sail may be furled, unless otherwise specifically indicated. The term 'second position' is used synonymously with terms such as unfurled position, deployed position, set position, or position for sailing, to indicate a position for a batten in which the batten supports the sail while the sail is in use.

Figure 1:
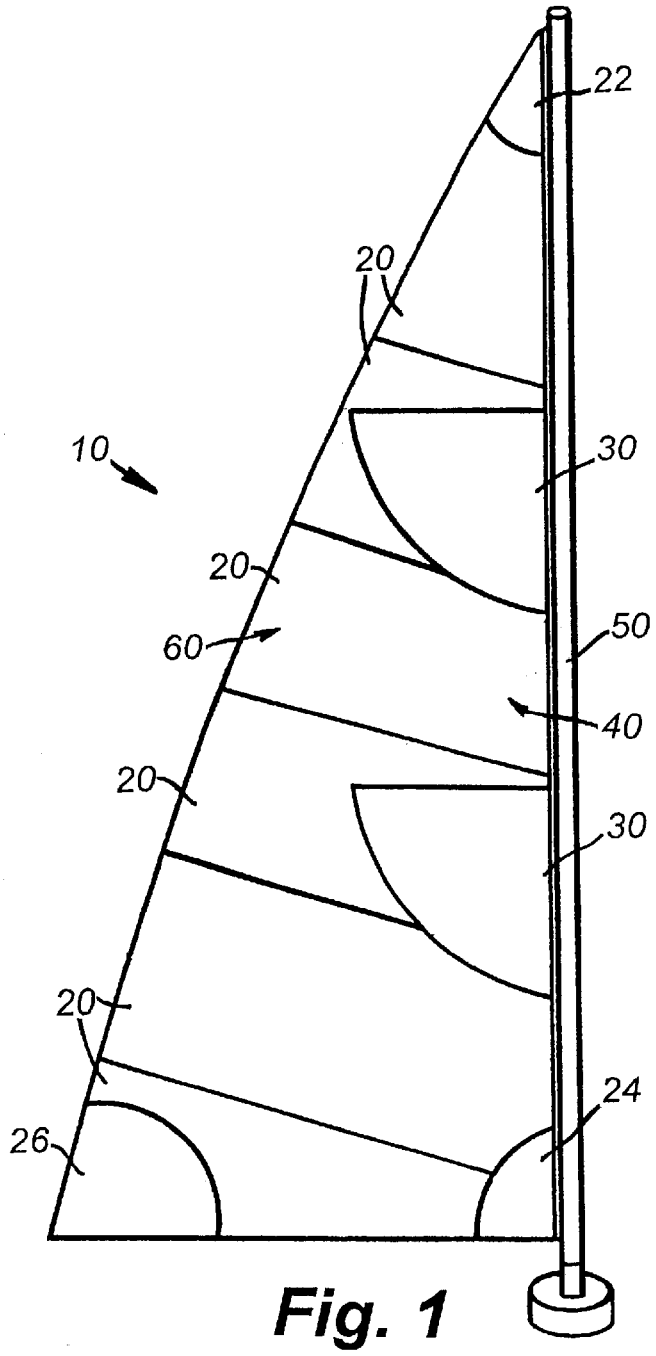
FIG. 1 depicts a roller furling sail with a pocket for a pivoting batten.

FIG. 1 depicts a roller furling sail with a pocket for a pivoting batten. A sail 10 may be fashioned from one or more panels attached to one another along respective edges. Each panel 20 of the sail 10 may be made of cotton, nylon, Dacron, Mylar, Kevlar, or any other plastic or other material or combination of materials that may be fashioned into sheets such as a canvas or a rolled laminate. The sail 10 may include several layers of sheet material of the same or different types, layered to form a composite sheet, and may include reinforcing fibers stitched to or laminated within the sheet material. The edges of the panels 20 may be attached to one another by stitching, adhesives, or any other technique suitable to form load-bearing seams between the panels 20. It will further be appreciated that while FIG. 1 illustrates a possible arrangement of panels 20, other arrangements are known in the art, and may be used with the sail 10 described herein. A head panel 22, a tack panel 24, and a clew panel 26 may be reinforced in any suitable manner to bear the point loads present on the corners of the sail 10.

A pocket 30 may include two or more plies of sheet material, forming a space therebetween in which a batten (not shown) may be moved between different positions. Generally, the batten may rotate into a first position, such as parallel with a luff 40 (which will be understood to mean generally the foreward-most region of a sail, or the right side of the sail 10 as depicted in FIG. 1) of the sail 10, so that the sail 10 may be rolled along an axis formed by the luff 40, or along a foil 50 attached to the luff 40. The batten may also rotate into a second position, such as perpendicular to the luff 40 or a leech 60 of the sail 10, so that the sail 10 may be supported in use along the leech 60 (which will be understood to mean generally the rear-most region of a sail, or the left side of the sail 10 as depicted in FIG. 1). It will be appreciated that the description herein of 'parallel' or 'perpendicular' orientations do not require strict geometric relationships, but also includes any near-parallel or near-perpendicular orientations that permits the sail 10 to be furled and unfurled. It will be further appreciated that other orientations may also be appropriate for certain sails, and that certain sails may have more than one of the battens and batten pockets described above.

A drum 70 is attached to a bottom of the foil 50. The drum 70 may be rotated by cables, ropes, or an electronic motor, or any other suitable mechanism, so that the sail 10 may be furled, as further depicted in FIG. 2, below.

Figure 2:
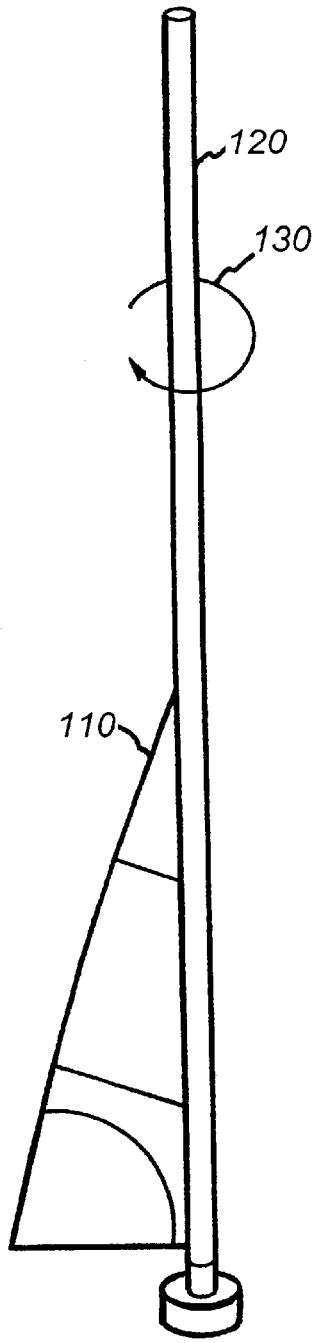
FIG. 2 depicts a roller-furling sail in a partially furled position.

FIG. 2 depicts a roller-furling sail in a partially furled position. When a batten is in the first position for furling, described in FIG. 1, a sail 110 may be furled by rotating a foil 120 or other assembly so that the sail 110 is wrapped about the foil 120, as indicated generally by an arrow 130 that depicts a circular motion of the foil 120. The sail 110 may be unfurled by rotating the foil 120 in the opposite direction. The sail 110 may be any sail that might be furled, including a mainsail, a mizzen, a jib, a genoa, and so forth, and may furl, for example, into a mast, into a boom, or about a stay.

Figure 3:
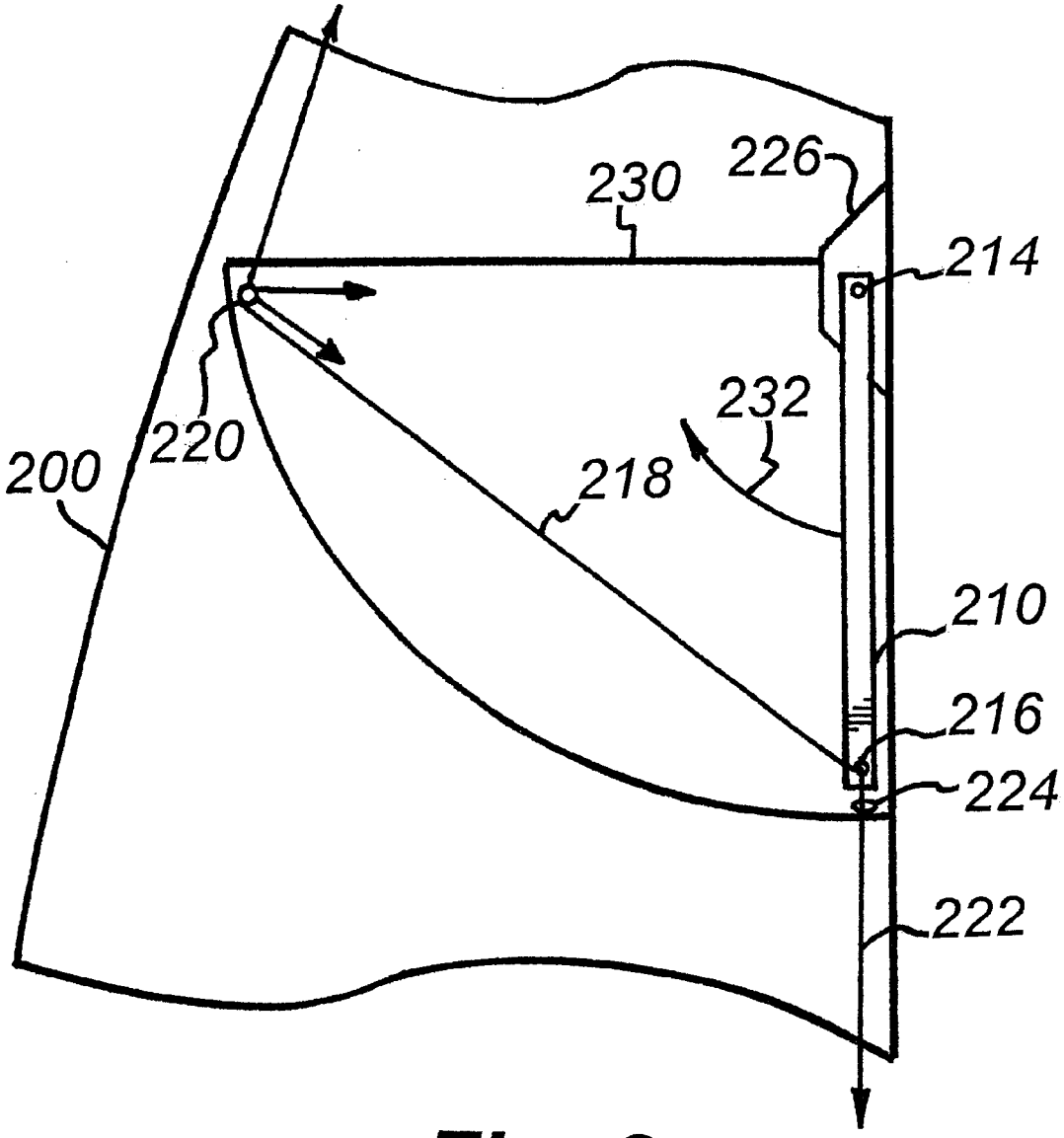
FIG. 3 depicts a pivoting batten in a first position.

FIG. 3 depicts a pivoting batten in a first position. The batten and control system of FIG. 3 may include a sail 200, a batten 210 with a pivot 214 at a first end and a fastener 216 at a second end, a first control line 218 attached to the fastener 216 and travelling through a first guide 220, a second control line 222 attached to the fastener 216 and travelling through a second guide 224, a reinforcement 226 for the pivot 214, and a pocket 230 enclosing the batten 210.

The batten 210 may be any rigid or semi-rigid member, formed from, for example, fiberglass, metal, plastic, wood, carbon fiber, or some composite material such as carbon fiber in an epoxy matrix. The pivot 214 may include a bolt, rivet, clevis pin, line, bearing, or any other suitable rotatable fixture. The pivot 214 may be supported by a reinforcement 226 attached to the sail 200 and/or the pocket 230. The reinforcement may include plastic, metal, wood, additional plies of sheet material, or any other suitable material for supporting the pivot 214 in its position in the sail 200.

The fastener 216 may be any device that permits a control line, such as the first control line 218 and the second control line 222, to be affixed to the batten 210, including, for example, a staple, an eyelet, a grommet through the batten 210, a glue or epoxy bead, or anything else to which a control line may be tied, glued, tacked, or otherwise attached. While depicted at an end of the batten 210, the fastener 216 may instead be at a midpoint of the batten 210, or at any other convenient location along the length of the batten 210, provided that the batten 210 can be rotated by exerting force to the fastener 216 through one of the control lines 218, 222.

In operation, the batten 210 rotates on the pivot 214, which may be located at or near a luff of the sail 200.

Rotation of the batten 210 is indicated generally by an arrow 232. The first control line 218 may be operated to rotate the batten 210 in the direction of the arrow 232 into a second position (not shown). The second control line 222 may be operated to rotate the batten 210 in the contrary direction into the first position. The inside surfaces of the pocket 230 may include chafe-resistant material or friction-reducing material to reduce wear on the pocket 230 and reduce the force required upon the first and second control lines 218, 222 to rotate the batten 210.

The first control line 218 and the second control line 222 may lead through one or more pulleys, chalks, grommets, or other leads, such as the first guide 220 and the second guide 224, to one or more locations where they may be pulled by a human operator or electro-mechanical device to rotate the batten between the first, furling position and the second, unfurled position. The first and second control lines 218, 222 may also pass through the materials forming the pocket 230, such as through grommets or the like, at any convenient location. As depicted in FIG. 3, the first control line 218 passes through the first guide 220 and may be further directed in any suitable manner, such as along the paths indicated by three arrows toward a head of the sail 200, toward a luff of the sail 200, or toward the second guide 224. The second control line 222 passes through the second guide 224 and may also be further directed in any suitable manner, such as down the luff of the sail 200. It will be appreciated that a number of other possible paths may be traversed by the control lines 218, 222, including a path down a leech of the sail 200 or through an interior region of the sail 200.

Further secondary guides may be provided for the first and second control lines 218, 222, such as strips of sail cloth stitched or otherwise fastened to the sail 200 to form channels in which the lines may travel. These secondary guides may not bear significant loads during operation of the control lines (which loads are born and directed by the guides such as the first guide 220 and the second guide 224), but may prevent long runs of the control lines from swinging loosely about the sail 200. The first control line 218 and the second control line 222 may be fastened using a cam, cleat, or other device for fastening lines, which device may be affixed to the sail 200 or to a spar or other location where it is operated. The lines 218, 222 may also be joined together on their respective control ends to form a single, continuous loop from the control location to the fastener 216 on the batten 210.

Figure 4:
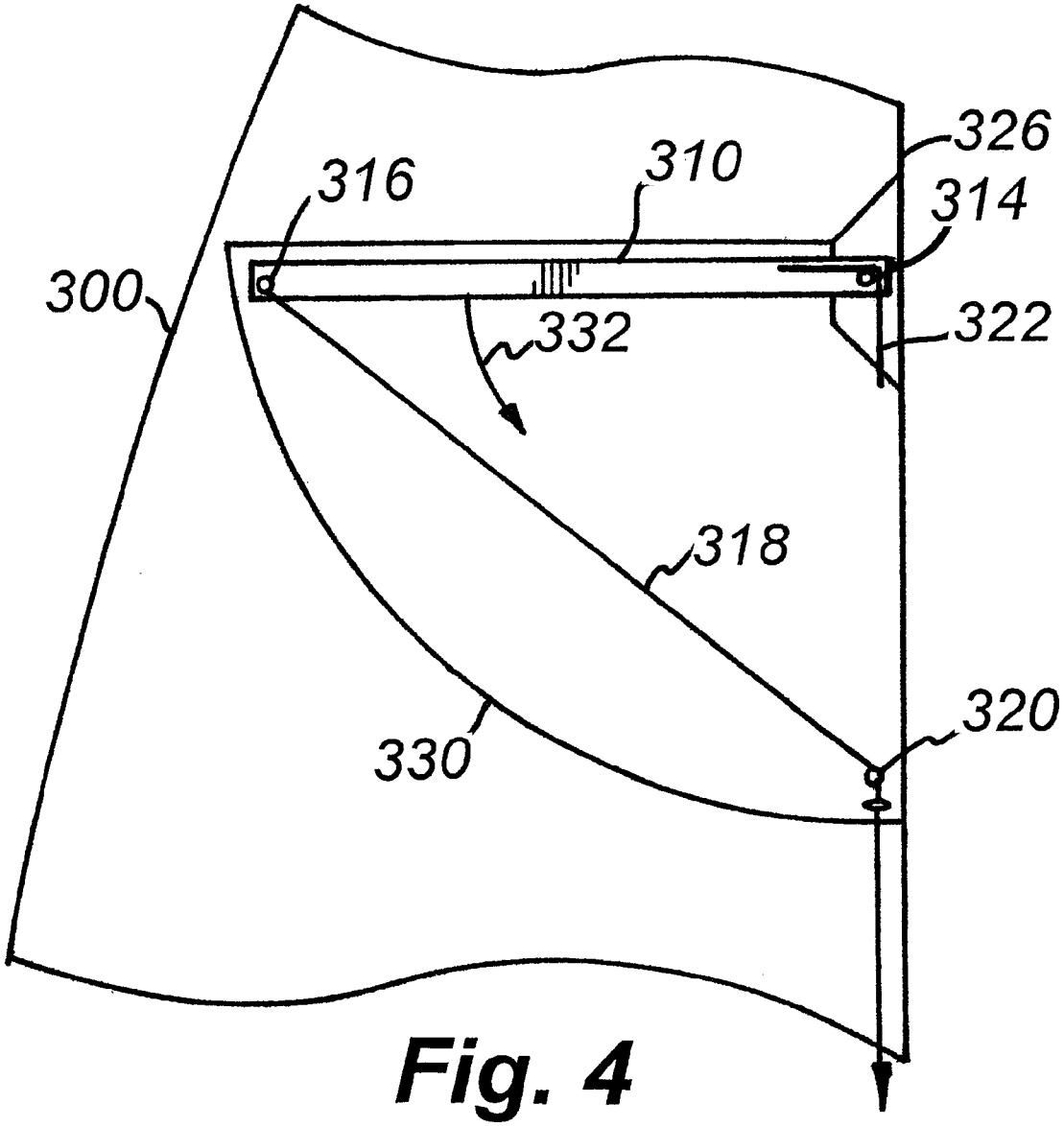
FIG. 4 depicts a pivoting batten in a second position.

FIG. 4 depicts a pivoting batten in a second position. The batten and control system of FIG. 4 may include a sail 300, a batten 310 with a pivot 314 at a first end and a fastener 316 at a second end, a first control line 318 attached to the fastener 316 and travelling through a first guide 320, a spring 322 attached to the batten 310, a reinforcement 326 for the pivot 314, and a pocket 330 enclosing the batten 310.

The elements of the batten and control system of FIG. 4 may be like those above described in reference to FIGS. 1–3, with differences as noted below. The spring 322, which may be a torsion spring or other spring-activated mechanism attached to the reinforcement 326 and to the batten 310, may exert torque upon the batten 310 near the pivot 314 that urges the batten 310 toward a second, unfurled position. The control line 318, which may conveniently be a single line, may be used to rotate the batten 310 toward a first position for furling, as indicated by an arrow 332. When the control line 318 is released, the spring 322 may urge the batten 310 again toward the second position, where it is depicted in FIG. 4, for use during sailing.

Other arrangements are possible for a spring-operated batten. For example, the spring may exert force to support the batten in a furling position, that is, parallel to the luff, with a control line provided to rotate a free end of the batten toward the leech. It will further be appreciated that other mechanisms may be used, alone or in combination with springs and/or control lines, to exert rotational force upon the batten, including a tension spring fastened to the moving end of the batten, or a pneumatic, magnetic, electromotive, or other actuator. The term 'control system' as used herein, is intended to refer to control lines, springs, and/or any other actuators or other devices for controlling movement of a batten between a position suitable for furling (typically vertical) and a position suitable for use while sailing (typically horizontal).

Figure 5:
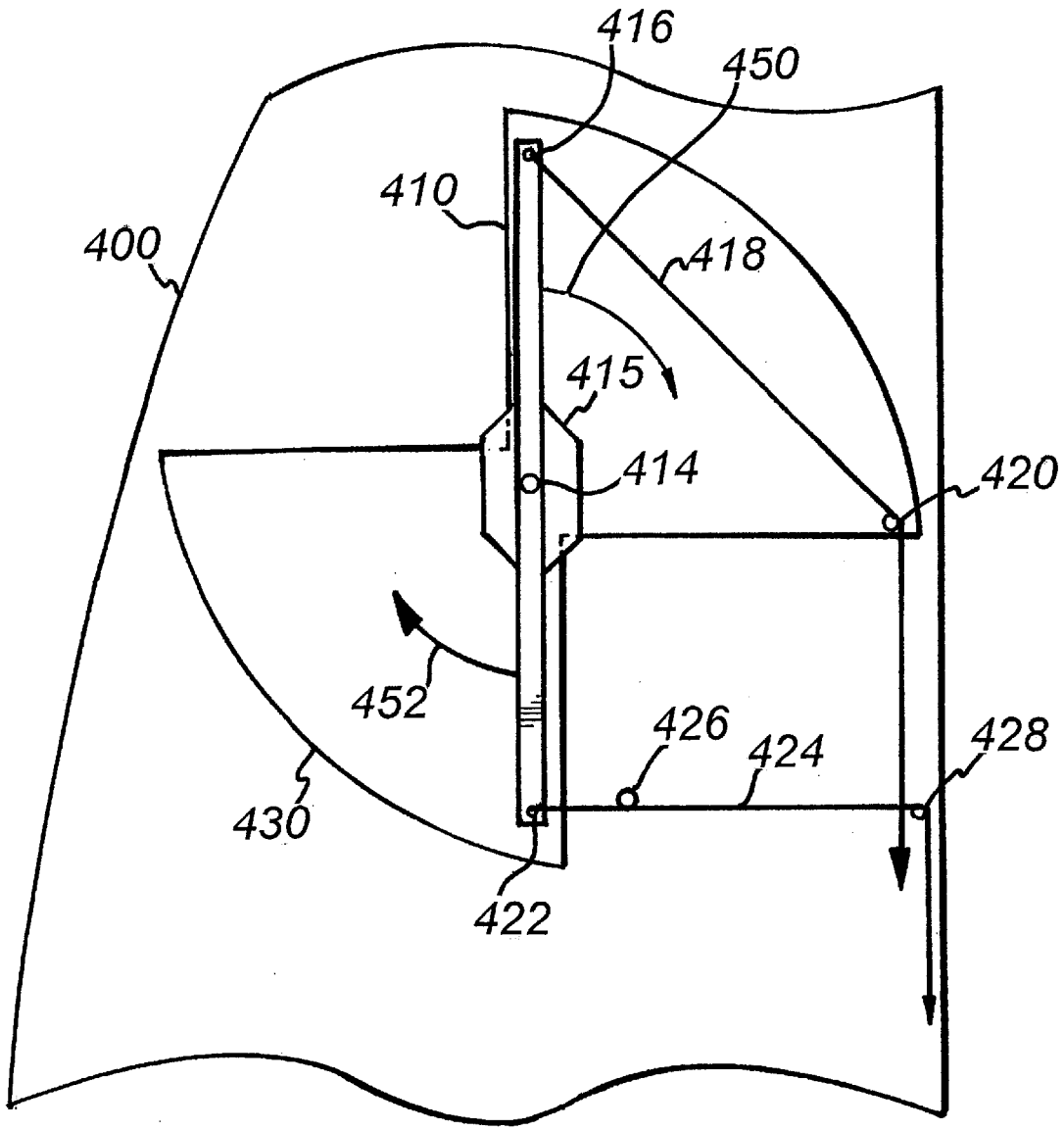
FIG. 5 depicts a control system and a center pivoting batten.

FIG. 5 depicts a control system and a center pivoting batten. The control system and batten may include a sail 400, a batten 410 with a pivot 414 in a center of the batten 410 and supported by a reinforcement 415, a first fastener 416 at a first end of the batten 410, a first control line 418 attached to the first fastener 416 and travelling through a first guide 420, a second fastener 422 at a second end of the batten 410, a second control line 424 travelling through a second guide 426 and a third guide 428, and a pocket 430 enclosing the batten 410. These elements may be the same as, or similar to, the elements described in reference to FIGS. 1–4, with differences as noted below.

As depicted in FIG. 5, the batten 410 may be rotated about a pivot 414 in its center. In order to accommodate a central, or near central pivot, the pocket 430 may have an approximately bow-tie shape. It will be appreciated that the pivot 414 may also be place off-center along the batten 410, with the two arcs varied in size to accommodate a longer and shorter rotating portion of the batten 410.

The first control line 418 and the second control line 424 may be affixed to opposite ends of the batten 410. By applying force to the first control line 418, and permitting the second control line 424 to run freely, the batten 410 may be urged from its furled position, as depicted, into an unfurled position, as indicated generally by a first arrow 450 and a second arrow 452. The batten 410 may, in complementary fashion, be urged from its unfurled position into the depicted position for furling by releasing the first control line 418 and applying force to the second control line 424. The first control line 418 and the second control line 428 may travel along a luff of the sail 400 to any position where they may be conveniently operated.

Figure 6:
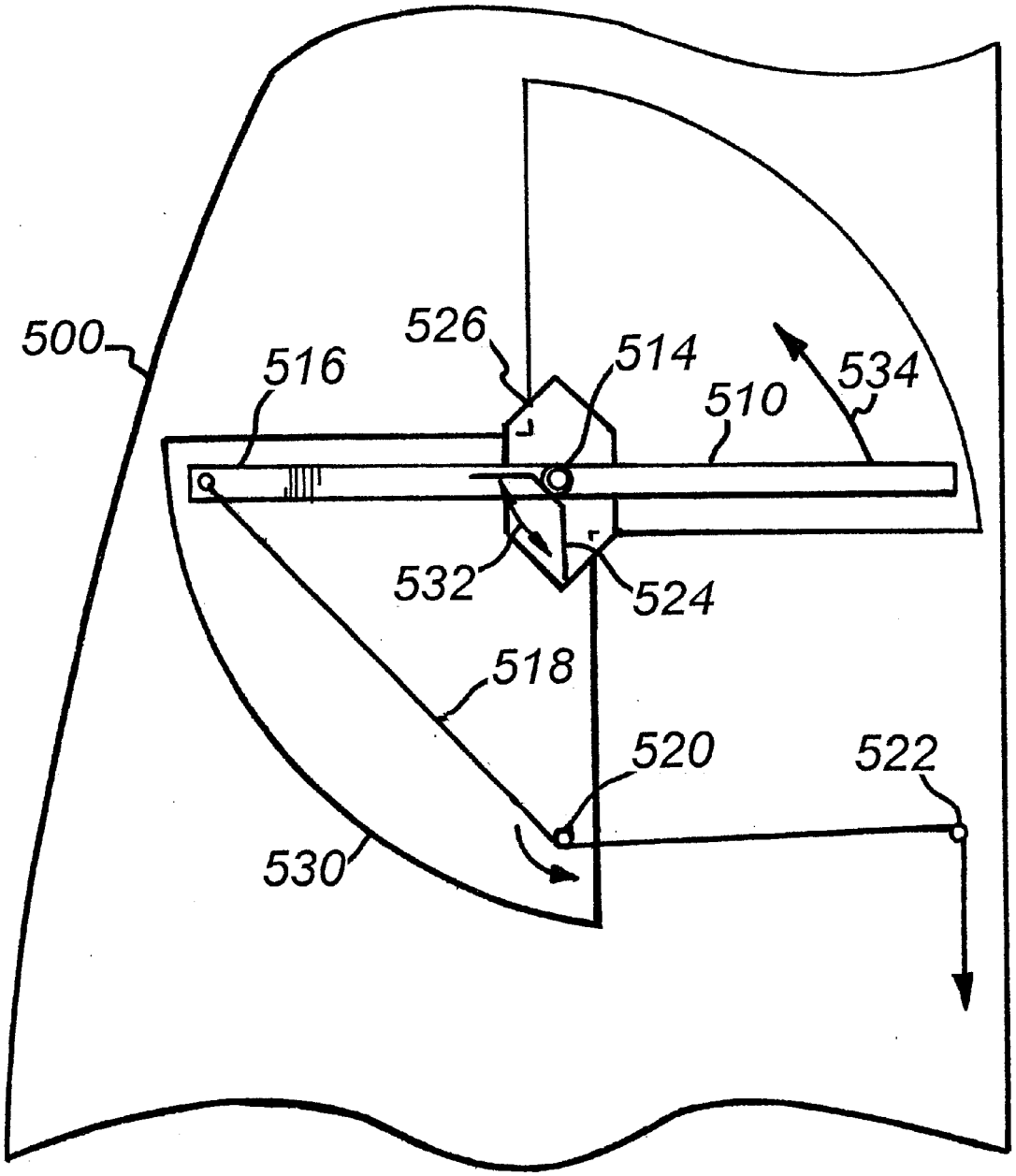
FIG. 6 depicts a control system and a center pivoting batten.

FIG. 6 depicts a control system and a center pivoting batten. The control system and center pivoting batten may include a sail 500, a batten 510 with a pivot 514 at a center of the batten 510, a fastener 516 at an end of the batten 510, a control line 518 attached to the fastener 516 and passing through a first guide 520 and a second guide 522, a spring 524 attached to the batten 510, a reinforcement 526 for the pivot 514, and a pocket 530 enclosing the batten 510. These elements maybe the same as, or similar to, the elements described in reference to FIGS. 1–5, with differences as noted below.

The spring 524 is affixed to the batten 510, and to the reinforcement 526, and applies a torque as indicated by a narrow 532. When the control line 518 is permitted to run free, the spring 524 urges the batten 510 toward a first position, which is the unfurled position depicted in FIG. 6. When force is applied to the control line 518 sufficient to overcome the torque of the spring 524, the batten 510 may be rotated as shown by a second arrow 534 into a second position which is the position for furling. It will be appreciated that the spring 524 may be configured to apply an opposite torque, so that it urges the batten 510 toward its furling position, while force is applied to the control line 516 (which would have a different configuration) to urge the batten 510 toward its unfurled position.

Figure 7:
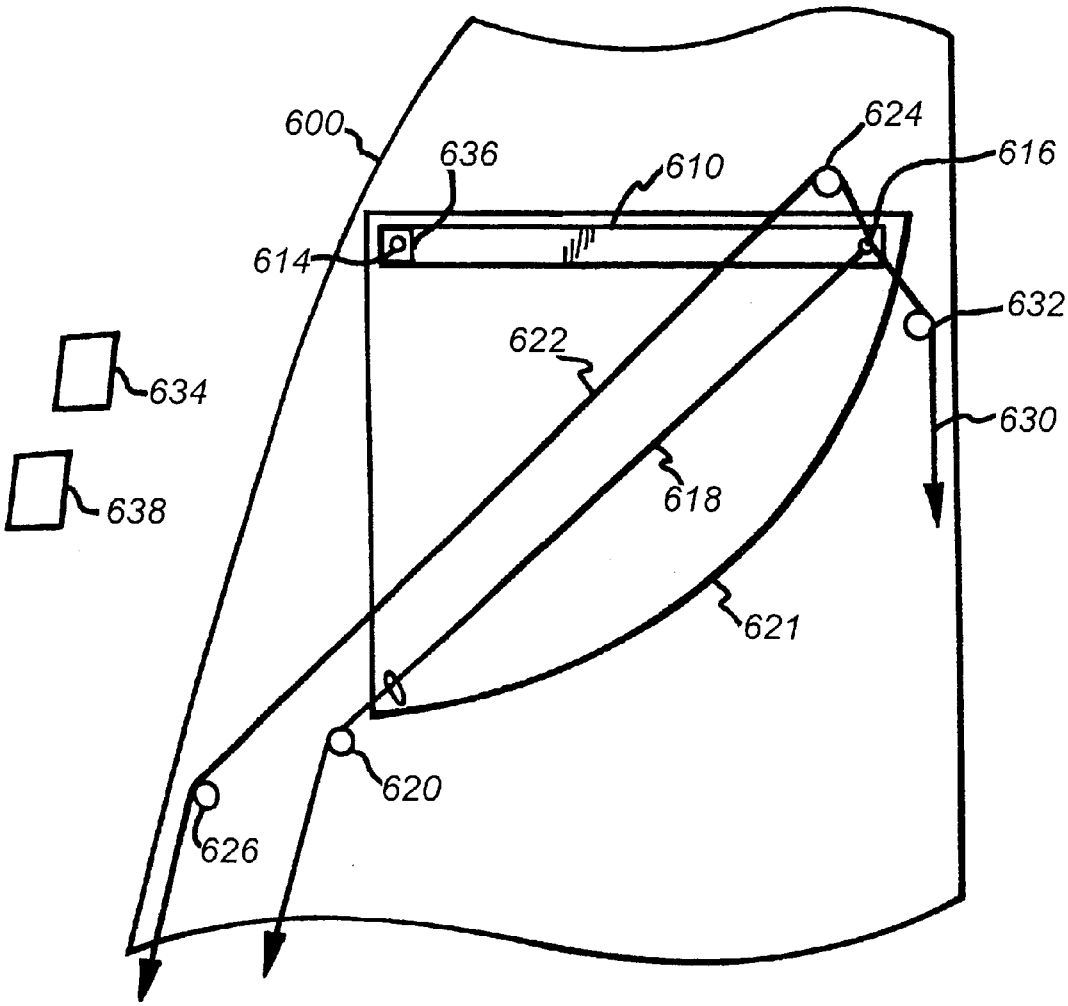
FIG. 7 depicts a control system and a leech pivoting batten.

FIG. 7 depicts a control system and a leech pivoting batten. The control system and leech pivoting batten may include a sail 600, a batten 610 with a pivot 614 at an end of the batten 610 near a leech of the sail 600, a fastener 616 at an end of the batten 610 away from the pivot 614, a first control line 618 attached to the fastener 616 and passing through a first guide 620 and along the sail through secondary guides to a foot of the sail 600, and a pocket 621 enclosing the batten 610. These elements may be the same as, or similar to, the elements discussed with reference to FIGS. 1–6.

The first control line 618 may be operated to draw the batten 610 into a position for furling the sail 600. Two alternative paths are shown for a second control line in order to illustrate the ease with which control lines may be led to a convenient location. In one embodiment of a second control line 622, the second control line 622 may pass through a second guide 624 and a third guide 626 to one or more secondary guides along the leech of the sail 600. In this configuration, for example, the first control line 618 and the second control line 622 may be conveniently terminated at a single location, such as along a boom at a foot of the sail 600. In another embodiment of the second control line 630, the second control line 630 may pass through a second guide 632 and through secondary guides along a luff of the sail 600. In this configuration, the second control line 630 may, for example maintain tension that secures the batten 610 in its unfurled position without deforming a shape of the leech of the sail 600. Other configurations of the control lines are possible, and may be used with the sails as described herein.

As illustrated, the pivot 614 may be attached to, or near, the leech of the sail 600. As with the other embodiments described herein, the control system may include a torsional spring that urges the sail toward an unfurled position or a furled position, with the complementary position obtained by applying force to a control line.

As will be appreciated, any of the control lines described herein may lead through many different paths to a control location located on a boom or mast, or may be secured with a cam or other fastener affixed directly to the sail. The control lines may optionally be led from the mast to a convenient location such as a cockpit. Operation of the control lines may be automated so that, for example, where furling and unfurling is controlled by an electro-mechanical system, battens may be rotated at appropriate times for furling and unfurling, by the same, or an associated, electro-mechanical system. The system may be controlled by a single switch 634 that is also activated by a user to furl and unfurl a sail.

In addition, rotation or other movement of the battens in the sails described herein may be affected through other techniques. For example, a servo or other motor or actuator, such as a step motor, hydraulic device, or pneumatic device, may be provided at the pivot 614. The actuator 636 may be activated remotely through a wireless interface 638 such as a radio frequency communication link, an infrared communication link, a microwave communication link, or any other electro-magnetic link capable of communicating control information to the actuator. Information communicated to the actuator may be binary, e.g., 'furled' or 'unfurled', or may (6 include continuous position information, e.g., degrees of rotation. In one embodiment, information communicated to the actuator may be simply 'rotate clockwise' or 'rotate counter-clockwise', or other suitable orientation or movement control, with a user observing movement of the batten and terminating a movement input at a suitable time, such as when the batten is in the furled or unfurled position. For a fully wireless system, the actuator 636 may be battery powered. Optionally, power may be provided to the actuator through wires from the pivot 614 to a battery or other power source, or, where power is provided in the control signal, from a controller for the actuator. Similarly, control signals, whether including power or separate from the power, may be provided to the actuator through wires or other electrically conductive leads from a controller to the actuator, following paths along the sail such as those described for the control lines.

It should also be noted that, while pockets with curved edges and battens that rotate about a pivot point function well, other pocket shapes may be used to accommodate other ranges of motion by a batten. For example, a batten may be drawn along an arced channel which, at one end, near the leech, is horizontal for one full batten-length, while at the other end, near the luff, is vertical for one full batten-length. By drawing a batten through this channel using control lines or actuators such as those discussed above, the batten may be positioned alternately for sailing and for furling.

It will also be appreciated that many combinations of the above systems may be used with a sail or other application as described herein. For example, a pneumatic actuator may be combined with a spring that provides a contrary torque. Or some battens may be powered by an actuator while others are operated by control lines. Or one batten may have and end-mounted pivot while another may have a centrally located pivot. All such combinations are intended to fall within the scope of the invention described herein. Thus, while the invention has been disclosed in connection with the preferred embodiments shown and described in detail, various modifications and improvements thereon will become readily apparent to those skilled in the art. It should be understood that all matter contained in the above description or shown in the accompanying drawings shall be interpreted as illustrative, and not in a limiting sense, and that the following claims should be interpreted in the broadest sense allowable by law.

What is claimed is:

1. An apparatus comprising:

a sail;

a batten secured to the sail by a pivot;

a pocket surrounding the batten and affixed to the sail, the batten having a furled position within the pocket and an unfurled position within the pocket; and a control system that controls a rotation of the batten about the pivot.

2. The apparatus of claim 1 further comprising a plurality of battens, each batten having a controllable rotational orientation.

3. The apparatus of claim 1 wherein the control system controls a rotation of the batten between the furled position and the unfurled position.

4. The apparatus of claim 1 wherein the control system further comprises at least one spring, the spring affixed to the batten and applying a torque to the batten toward at least one of the furled position and the unfurled position.

5. The apparatus of claim 1 wherein the control system further comprises an actuator that controls a rotational orientation of the batten.

6. The apparatus of claim 5 wherein the actuator includes at least one of a step motor, a servo, a pneumatic device, or a hydraulic device.

7. The apparatus of claim 5 wherein the actuator is controlled through a wireless interface.

8. The apparatus of claim 1 wherein the pocket includes a lining of at least one of a chafe-resistant or a friction-reducing material.

9. The apparatus of claim 1 further comprising a roller furling system.

10. The apparatus of claim 1 further comprising a switch, the switch being activated by a user to rotate the batten between the furled position and the unfurled position.

11. The apparatus of claim 1 wherein the pivot is located at an end of the batten, the end of the batten being on at least one of a luff-side of the sail or a leech-side of the sail.

12. The apparatus of claim 1 wherein the pivot is located at a center of the batten.

13. An apparatus comprising:

a batten;

a pivot attached to the batten;

a pocket surrounding the batten, the batten having a furled position within the pocket and an unfurled position within the pocket; and a fastener securing a control line to the batten and positioned so that a force applied to the line will rotate the batten about the pivot.

14. An apparatus comprising:

a pliable sheet of material;

a rigid member secured to the pliable sheet of material by a pivot;

a pocket surrounding the rigid member and affixed to the pliable sheet of material, the rigid member having a stowed position within the pocket and a deployed position within the pocket; and a control system that controls a rotation of the rigid member about the pivot.

15. The apparatus of claim 1 wherein the control system further comprises one or more control lines, each control line affixed to the batten and operable to rotate the batten toward at least one of the furled position and the unfurled position.

* * * * *